US012384980B2

(12) United States Patent
Gao et al.

(10) Patent No.: US 12,384,980 B2
(45) Date of Patent: Aug. 12, 2025

(54) INTERNAL COMBUSTION ENGINE LUBRICANT

(71) Applicant: ExxonMobil Technology and Engineering Company, Spring, TX (US)

(72) Inventors: Zhisheng Gao, Flemington, NJ (US); Winfried Koch, Hamburg (DE); Nicholas W. McBride, Morristown, NJ (US); Dana J. Gary, Pittstown, NJ (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 18/651,091

(22) Filed: Apr. 30, 2024

(65) Prior Publication Data

US 2024/0368493 A1 Nov. 7, 2024

Related U.S. Application Data

(60) Provisional application No. 63/499,621, filed on May 2, 2023.

(51) Int. Cl.

| | |
|---|---|
| ***C10M 111/04*** | (2006.01) |
| ***C10L 1/04*** | (2006.01) |
| ***C10M 105/38*** | (2006.01) |
| ***C10M 107/08*** | (2006.01) |
| ***C10M 129/10*** | (2006.01) |

(Continued)

(52) U.S. Cl.

CPC ..... *C10M 111/04* (2013.01); *C10L 1/04* (2013.01); *C10M 105/38* (2013.01); *C10M 107/08* (2013.01); *C10M 129/10* (2013.01); *C10M 133/12* (2013.01); *C10M 141/06* (2013.01); *C10M 169/04* (2013.01); *C10L 2270/02* (2013.01); *C10M 2205/0265* (2013.01); *C10M 2207/023* (2013.01); *C10M 2207/2835* (2013.01); *C10M 2215/26* (2013.01); *C10N 2020/02* (2013.01); *C10N 2030/02* (2013.01); *C10N 2030/10* (2013.01);

(Continued)

(58) Field of Classification Search

CPC .. C10M 111/04; C10M 105/38; C10M 107/08

See application file for complete search history.

(56) References Cited

U.S. PATENT DOCUMENTS

| | | | |
|---|---|---|---|
| 2,100,993 | A | 11/1937 | Bruson |
| 3,036,003 | A | 5/1962 | Arthur |

(Continued)

FOREIGN PATENT DOCUMENTS

| | | | |
|---|---|---|---|
| CA | 1094044 | A | 1/1981 |

*Primary Examiner* — Ellen M McAvoy

(74) *Attorney, Agent, or Firm* — Vorys, Sater, Seymour and Pease LLP

(57) ABSTRACT

A lubricant composition may be of use in lubrication of an internal combustion engine. A method of utilizing such a lubricant composition may include: lubricating an internal combustion engine using a lubricant composition comprising: from about 30.0 mass % to about 99.8 mass % of an oil base stock, based on a total mass of the lubricant composition, the oil base stock comprising at least one polyol ester; and from 1.0 mass % to 30.0 mass % polyisobutylene, based on a total mass of the lubricant composition; and combusting a fuel in the internal combustion engine.

24 Claims, 1 Drawing Sheet

(51) Int. Cl.

| | |
|---|---|
| ***C10M 133/12*** | (2006.01) |
| ***C10M 141/06*** | (2006.01) |
| ***C10M 169/04*** | (2006.01) |
| *C10N 20/02* | (2006.01) |
| *C10N 30/00* | (2006.01) |
| *C10N 30/02* | (2006.01) |
| *C10N 30/10* | (2006.01) |
| *C10N 40/25* | (2006.01) |

(52) U.S. Cl.
CPC ..... *C10N 2030/43* (2020.05); *C10N 2030/45* (2020.05); *C10N 2040/25* (2013.01)

(56) References Cited

U.S. PATENT DOCUMENTS 3,087,936 A 4/1963 Le Suer
3,172,892 A 3/1965 Le Suer
3,215,707 A 11/1965 Rense et al.
3,219,666 A 11/1965 Norman et al.
3,254,025 A 5/1966 Le Suer
3,272,746 A 9/1966 Le Suer et al.
3,275,554 A 9/1966 Wagenaar
3,316,177 A 4/1967 Dorer, Jr.
3,322,670 A 5/1967 Burt et al.
3,329,658 A 7/1967 Fields
3,341,542 A 9/1967 Le Suer et al.
3,413,347 A 11/1968 Worrel
3,438,757 A 4/1969 Honnen et al.
3,444,170 A 5/1969 Norman et al.
3,449,250 A 6/1969 Fields
3,454,555 A 7/1969 Van Der Voort et al.
3,454,607 A 7/1969 Le Suer et al.
3,519,565 A 7/1970 Coleman
3,541,012 A 11/1970 Stuebe
3,565,804 A 2/1971 Honnen et al.
3,595,791 A 7/1971 Cohen
3,630,904 A 12/1971 Musser et al.
3,632,511 A 1/1972 Liao
3,652,616 A 3/1972 Watson et al.
3,666,730 A 3/1972 Coleman
3,687,849 A 8/1972 Abbott
3,697,574 A 10/1972 Piasek et al.
3,702,300 A 11/1972 Coleman et al.
3,703,536 A 11/1972 Piasek et al.
3,704,308 A 11/1972 Piasek et al.
3,725,277 A 4/1973 Worrel
3,725,480 A 4/1973 Traise et al.
3,726,882 A 4/1973 Traise et al.
3,751,365 A 8/1973 Piasek et al.
3,755,433 A 8/1973 Miller et al.
3,756,953 A 9/1973 Piasek et al.
3,787,374 A 1/1974 Adams
3,798,165 A 3/1974 Piasek et al.
3,803,039 A 4/1974 Piasek et al.
3,822,209 A 7/1974 Knapp et al.
3,948,800 A 4/1976 Meinhardt
4,100,082 A 7/1978 Clason et al.
4,234,435 A 11/1980 Meinhardt et al.
4,426,305 A 1/1984 Malec
4,454,059 A 6/1984 Pindar et al.
4,589,990 A * 5/1986 Zehler ..... C10M 143/06 585/12
4,652,416 A 3/1987 Millot
4,956,122 A 9/1990 Watts
5,084,197 A 1/1992 Galic et al.
5,366,648 A 11/1994 Salomon et al.
5,705,458 A 1/1998 Roby et al.
5,858,935 A * 1/1999 Watts ..... C10M 111/04 508/491
6,034,039 A 3/2000 Gaspar Gomes et al.
6,323,164 B1 11/2001 Liesen et al.
7,704,930 B2 4/2010 Deckman et al.
8,247,358 B2 8/2012 Lee et al.
8,492,321 B2 7/2013 Goujon et al.
11,345,872 B2 5/2022 Gao
2010/0101518 A1* 4/2010 Bardasz ..... C10M 169/045 508/463
2012/0309658 A1* 12/2012 Carey ..... C10M 111/04 508/463
2014/0228267 A1* 8/2014 Rea ..... C10M 105/38 508/485
2015/0018260 A1* 1/2015 Benecke ..... C07C 51/34 560/204
2015/0322368 A1 11/2015 Patel et al.
2016/0075967 A1* 3/2016 Gao ..... C10M 107/34 508/459
2018/0057769 A1* 3/2018 Gao ..... C10M 105/38
2019/0062667 A1* 2/2019 Gao ..... C10M 135/06
2019/0338213 A1* 11/2019 Gao ..... C10M 133/12

* cited by examiner

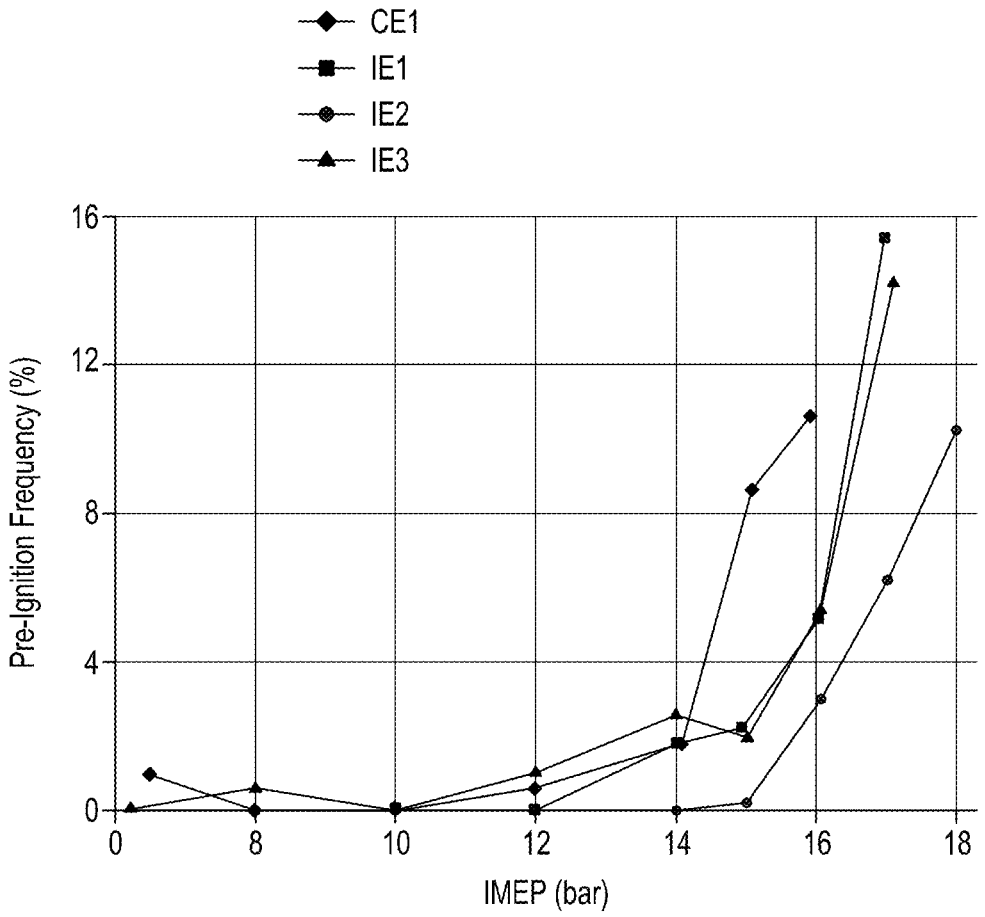
CE1
IE1
IE2
IE3
Pre-Ignition Frequency (%)
16
12
8
4
0
0
8
10
12
14
16
18
IMEP (bar)

INTERNAL COMBUSTION ENGINE LUBRICANT

FIELD OF INVENTION

This application generally relates to lubricant compositions and processes for making the same. More particularly, this application relates to engine lubricant compositions for reducing pre-ignition tendency and processes for making the same.

BACKGROUND

Conventional engine lubricants generally contain, among other things, an oil base stock, at least one antiwear additive to reduce friction between engine parts, at least one detergent to help maintain engine cleanliness, at least one dispersant to suspend contaminants in the oil, and at least one antioxidant.

Hydrogen-fueled internal combustion engines have grown in interest in recent years for powering commercial and passenger vehicles as well as power generation. "Hydrogen-fueled" includes engines fueled with hydrogen alone, as well as engines fueled with a mixture of hydrogen and a hydrocarbon (e.g., petroleum, natural gas, and the like). Hydrogen-fueled internal combustion engines have a potential to significantly reduce or even eliminate greenhouse gas emissions due to the nature of hydrogen combustion only producing water as output. Hydrogen-fueled internal combustion engine types of interest include spark-ignited engines.

SUMMARY OF INVENTION

A nonlimiting method of the present disclosure includes: lubricating an internal combustion engine using a lubricant composition comprising: from about 30.0 mass % to about 99.8 mass % of an oil base stock, based on a total mass of the lubricant composition, the oil base stock comprising at least one polyol ester; and from 1.0 mass % to 30.0 mass % polyisobutylene, based on a total mass of the lubricant composition; and combusting a fuel in the internal combustion engine.

A first nonlimiting lubricant composition of the present disclosure includes: from about 30.0 mass % to about 99.8 mass % of an oil base stock, based on a total mass of the lubricant composition, the oil base stock comprising at least one polyol ester; and from 1.0 mass % to 30.0 mass % polyisobutylene, based on a total mass of the lubricant composition; wherein the lubricant composition comprises about 0.05 mass % or less ash.

A second nonlimiting lubricant composition of the present disclosure includes: from about 30.0 mass % to about 99.8 mass % of an oil base stock, based on a total mass of the lubricant composition, wherein the oil base stock has a kinematic viscosity (ASTM D445) of from 1 cSt to 10 cSt at 100° C.; and from 1.0 mass % to 30.0 mass % polyisobutylene, based on a total mass of the lubricant composition; and wherein the lubricant composition comprises about 0.05 mass % or less ash.

These and other features and attributes of the disclosed compositions and methods of the present disclosure and their advantageous applications and/or uses will be apparent from the detailed description which follows.

BRIEF DESCRIPTION OF THE DRAWINGS

To assist those of ordinary skill in the relevant art in making and using the subject matter hereof, reference is made to the appended drawings. The following FIGURES are included to illustrate certain aspects of the disclosure, and should not be viewed as exclusive configurations. The subject matter disclosed is capable of considerable modifications, alterations, combinations, and equivalents in form and function, as will occur to those skilled in the art and having the benefit of this disclosure.

The FIGURE shows a graph of results of engine testing for a comparative example and IE1-IE3.

DETAILED DESCRIPTION

This application generally relates to lubricant compositions and processes for making the same. More particularly, this application relates to engine lubricant compositions for reducing pre-ignition tendency and processes for making the same.

The term "mass %" as used herein indicates percentage by mass such as percentage by weight, "vol %" as used herein indicates percentage by volume, "mol %" as used herein indicates percentage by mole, "ppm" as used herein indicates parts per million, and "ppm wt" and "wppm" are used interchangeably and mean parts per million on a weight basis. All concentrations herein, unless otherwise stated, are expressed on the basis of the total amount of the composition in question.

The term "polymer" as used herein refers to any two or more of the same or different repeating units/mer units or units. The term "homopolymer" as used herein refers to a polymer having units that are the same. The term "copolymer" as used herein refers to a polymer having two or more units that are different from each other and includes terpolymers and the like. The term "terpolymer" as used herein refers to a polymer having three units that are different from each other. The term "different" as used herein as it refers to units indicates that the units differ from each other by at least one atom or are different isomerically. Likewise, the definition of polymer, as used herein, includes homopolymers, copolymers, and the like.

The term "oil base stock" as used herein refers to any base fluid that could be used in a lubricant including, but not limited to, a terpene, a mineral oil, a synthetic hydrocarbon, an ester, the like, or any combination thereof. An oil base stock as used herein may include Group I, II, III, IV, and V (as defined by American Petroleum Institute [API]) base oils, including any combination thereof. The terms "base oil", "oil base stock", "oil basestock," "basestock oil," "base stock oil," simply "basestock," or any grammatical variations thereof are used interchangeably herein.

The term "alphaolefin" refers to any linear or branched compound of carbon and hydrogen having at least one double bond between the a and R carbon atoms. For purposes of this specification and the claims appended thereto, when a polymer or copolymer is referred to as including an alpha-olefin (e.g., a polyalphaolefin) the alpha-olefin present in such polymer or copolymer is the polymerized form of the alpha-olefin.

The present disclosure includes compositions and methods of making and applying thereof, including lubricant compositions for reducing pre-ignition frequency. The compositions of the present disclosure may be used as an engine oil, for example in internal combustion applications, in particular internal combustion engines fueled by hydrogen. "Hydrogen-fueled," "fueled by hydrogen," and grammatical variants thereof refer to an internal combustion engine at least partially fueled by hydrogen; a hydrogen-fueled engine may be fueled by a blend of hydrogen and a hydrocarbon (e.g., natural gas, petroleum, gasoline, the like, or any combination thereof). As hydrogen-fueled internal combustion engines have a potential to significantly reduce or even eliminate greenhouse gas emissions, potential interest in said engines has significantly increased. Hydrogen and hydrogen-hydrocarbon blends, however, have increased reactivity compared with conventional hydrocarbon fuels (e.g., natural gas, gasoline, the like) due to lower minimum ignition energy. As a result, hydrogen-fueled engines may have a higher pre-ignition tendency. "Pre-ignition," "pre-ignition frequency," "pre-ignition tendency" and grammatical variations thereof is defined as an engine igniting a fuel-air mixture while a piston is still in a compression stage and/or before the spark of a spark plug has ignited the fuel-air mixture. Pre-ignition may result in reduced engine efficiency. As a result of the potential for pre-ignition, many hydrogen-fueled engines may be forced to be operated at reduced pressure (e.g., reduced indicated mean effective pressure (IMEP)).

Compositions and methods of the present disclosure may allow for use of low reactivity lubricants in hydrogen-fueled internal combustion engines whereby the lubricant reduces pre-ignition tendency. Reduction in pre-ignition frequency may allow for hydrogen-fueled engines to operate at higher pressure (e.g., higher IMEP) and thus at higher overall efficiency, potentially enabling reduced engine emissions and/or reduced fuel usage.

Lubricant Compositions

Lubricant compositions of the present disclosure may include from about 30.0 mass % to about 99.8 mass % (or about 50.0 mass % to about 99.8 mass %, or about 60.0 mass % to about 99.8 mass %, or about 80.0 mass % to about 99.8 mass %, or about 30.0 mass % or greater, or about 50.0 mass % or greater) of an oil base stock, based on a total mass of the lubricant composition. The oil base stock may preferably comprise at least one polyol ester, the polyol ester preferably being highly branched. The lubricant compositions may further comprise one or more of: viscosity index improvers, detergents, antioxidants, etc.

The lubricant compositions of the present disclosure may be low-ash, low-sulfur, low-phosphorous, or any combination thereof. The term "low-sulfur" as used herein indicates that a lubricant composition has less than about 0.05 mass % (or preferably less than about 0.03 mass %, or more preferably less than about 0.01 mass %, of sulfur). The term "low-ash" as used herein indicates that the lubricant composition has less than about 0.05 mass % (or preferably less than about 0.03 mass %, or more preferably less than about 0.01 mass %, of metal material). "Metal material" as used herein refers to metals in the lubricant composition, including, but not limited to, calcium, magnesium, sodium, the like, or any combination thereof. The term "low-phosphorus" as used herein indicates that the lubricant composition is less than about 0.05 mass % (or preferably less than about 0.03 mass %, or more preferably less than about 0.01 mass %), of phosphorus. All of the foregoing mass percentages are based on the total mass of the lubricant composition.

Oil Base Stock

The oil base stock components used herein may include any of the well-known American Petroleum Institute (API) categories of Group I through Group V, including combinations thereof. The API defines Group I stocks as solvent-refined mineral oils. Group I stocks contain the least saturates and highest amount of sulfur and generally have the lowest viscosity indices. Group II and III stocks are high viscosity index and very high viscosity index base stocks, respectively. The Group III oils generally contain fewer unsaturates and sulfur than the Group II oils.

Group IV stocks consist of polyalphaolefins, which are produced via the catalytic oligomerization of linear alphaolefins (LAOs), particularly LAOs selected from C5-C14 alphaolefins, including, but not limited to, from 1-hexene to 1-tetradecene, 1-octene to 1-dodecene, and mixtures thereof, with 1-decene being the preferred material, although oligomers of lower olefins such as ethylene and propylene, oligomers of ethylene/butene-1 and isobutylene/butene-1, and oligomers of ethylene with other higher olefins, as described in U.S. Pat. No. 4,956,122 and the patents referred to therein, and the like, or any combinations thereof may also be used. Additional further description of suitable polyalphaolefins may be found in U.S. Pat. No. 11,345,872.

Group V includes all the other base stocks not included in Groups I through IV. Group V base stocks includes lubricants based on or derived from esters. Group V additionally includes alkylated aromatics, polyalkylene glycols (PAGs), alkylated naphthalene, the like, or any combination thereof.

The present disclosure may preferably include a lubricant with a base stock oil comprising a Group V base stock, the Group V base stock preferably comprising an ester. Additive solvency and seal compatibility characteristics may be increased by the use of esters. Suitable esters may include, but are not limited to, esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, the like, or any combination thereof, with a variety of alcohols such as butyl alcohol, hexyl alcohol, dodecyl alcohol, 2-ethylhexyl alcohol, the like, or any combination thereof. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the like, or any combination thereof. It should be noted that suitable esters may, for example, have at least 50% (or at least 25%, or 25% to 50%, or 25% to 75%, or 25% to 90%) of carbon atoms in the form of methyl groups.

Particularly useful synthetic esters are those which are obtained by reacting one or more polyhydric alcohols, preferably the hindered polyols (such as the neopentyl polyols, including, but not limited to, neopentyl glycol, trimethylol ethane, 2-methyl-2-propyl-1,3-propanediol, trimethylol propane, pentaerythritol, and dipentaerythritol, the like, and combinations thereof) with alkanoic acids containing at least about 3 carbon atoms, preferably C5 to C30 acids, more preferably C8 to C12, and even more preferably C8 to C10. Suitable alkanoic acids may include, but are not limited to, saturated straight chain alkanoic acids (e.g., including, but not limited to, caprylic acid, capric acid, lauric acid, myristic acid, palmitic acid, stearic acid, arachic acid, and behenic acid, the like, or any combination thereof), saturated branched chain alkanoic acids (e.g., including, but not limited to, 3,5,5-trimethylhexanoic acid, 4,8,12-trimethyltridecanoic acid, phytanic acid, pristanic acid, the like, or any combination thereof), or unsaturated fatty acids (e.g., including, but not limited to, oleic acid, the like, or any combination thereof), or combinations of any of these materials.

Example suitable synthetic ester components include, but are not limited to, the esters of trimethylol propane, trimethylol butane, trimethylol ethane, pentaerythritol, dipentaerythritol, neopentyl glycol with one or more monocarboxylic acids containing from about 5 to about 12 or more carbon atoms. Example suitable monocarboxylic acids may include, but are not limited to, 3,5,5-trimethylhexanoic acid, the like, or any combination thereof. Preferred esters may include neopentylglycol di(3,5,5-trimethylhexanoate), trimethylolpropane tri(3,5,5-trimethylhexanoate), the like, or any combination thereof.

Another example of a suitable ester may be mixed pentaerythritol esters of branched alkanoic acids. Such mixed esters may have properties including from about 1 mol % to about 5 mol % primary carbon, from about 30 mol % to about 40 mol % secondary carbon, and from about 40 mol % to about 50 mol % tertiary carbon, and from about 15 mol % to about 25 mol % quaternary carbon (as determined by carbon-13 NMR)

Suitable esters are widely available commercially, for example, ESTEREX™ A41 and ESTEREX™ A51, are available from ExxonMobil Chemical Company.

Also useful are esters derived from renewable material such as coconut, palm, rapeseed, soy, sunflower and the like. These esters may be monoesters, di-esters, polyol esters, complex esters, or mixtures thereof.

The basestock oil useful in the present disclosure may have any suitable kinematic viscosity. Suitable kinematic viscosities (ASTM D445) at 100° C. may, for example, be from about 1 centistokes (cSt) to about 50 cSt, preferably about 2 cSt to about 30 cSt, more preferably about 2 cSt to about 25 cSt, more preferably 1 cSt to 10 cSt, more preferably about 2 cSt to 10 cSt, and even more preferably about 2 cSt to about 8 cSt.

The basestock oil included in the lubricant compositions of the present disclosure may be present at a concentration of from about 30.0 mass % to about 99.8 mass % (or 40 mass % to 99.8 mass %, or 40 mass % to 99 mass %, or 40 mass % to 90 mass %, or 40 mass % to 80 mass %, or 50 mass % to 99.8 mass %, or 50 mass % to 99 mass %, or 50 mass % to 90 mass %, or 50 mass % to 80 mass %, or 60 mass % to 99.8 mass %, or 60 mass % to 99 mass %, or 60 mass % to 90 mass %, or 60 mass % to 80 mass %, or 70 mass % to 99.8 mass %, or 70 mass % to 99 mass %, or 70 mass % to 90 mass %, or 70 mass % to 80 mass %).

Viscosity Modifier

One or more viscosity modifiers (also known as "Viscosity Index Improvers", "VI improvers," and "viscosity improvers") may be included in the lubricant compositions of the present disclosure. Viscosity modifiers can increase the viscosity of the lubricant. In some cases, viscosity modifiers can serve to provide lubricants with high and low temperature operability. These additives impart shear stability at elevated temperatures and acceptable viscosity at low temperatures. The viscosity modifier can be present in the lubricant composition in an amount from about 1.0 mass % to about 30.0 mass % (or about 1.0 mass % to about 20.0 mass %, or about 5.0 mass % to about 15.0 mass %, or about 8.0 to about 12.0 mass %, or about 10.0 mass %, or about 5.0 mass %), based on the total mass of the lubricant composition.

Suitable viscosity modifiers include high molecular weight hydrocarbons, polyesters, and viscosity modifier dispersants that function as both a viscosity index improver and a dispersant. Typical molecular weights of these polymers are between about 10,000 to 1,500,000, more typically about 20,000 to about 1,200,000, and even more typically about 50,000 to about 1,000,000. The typical molecular weight for polymethacrylate or polyacrylate viscosity modifiers is less than about 50,000.

Examples of suitable viscosity modifiers are linear or star-shaped polymers and copolymers of methacrylate, isobutylene, butadiene, olefins, or alkylated styrenes. Preferred viscosity modifiers may include polyisobutylene. Another suitable viscosity modifier is polymethacrylate (e.g., copolymers of various chain length alkyl methacrylates), some formulations of which also serve as pour point depressants. Other suitable viscosity modifiers include, but are not limited to, copolymers of ethylene and propylene, hydrogenated block copolymers of styrene and isoprene, and polyacrylates (copolymers of various chain length acrylates, for example). Specific examples include, but are not limited to, styrene-isoprene or styrene-butadiene based polymers having a molecular weight of about 50,000 to 200,000.

Suitable olefin copolymers include, but are not limited to, those commercially available from: Chevron Oronite under the tradename PARATONE® (such as PARATONEX® 8921 and PARATONE® 8941); Afton Chemical Corporation under the tradename HITEC® (such as HITEC® 5850B); and The Lubrizol Corporation under the tradename LUBRIZOL® 7067C. Hydrogenated polyisoprene star polymers may include, but are not limited to, those commercially available from Infineum International under the tradename SV200 and SV600. Hydrogenated diene-styrene block copolymers may include, but are not limited to, those commercially available from Infineum International, e.g., under the tradename SV 50.

Ashless Antiwear Additive

The ashless antiwear additive can serve to reduce wear between engine parts. The antiwear additive can be or can include an amine phosphate, an over-neutralized amine phosphate, or combinations thereof. The amine phosphate can be prepared by reacting an amine compound or a polyamine compound with a phosphoric acid. Suitable amines are disclosed in U.S. Pat. No. 4,234,435, the relevant portions thereof being incorporated by reference herein. An "over-neutralized" amine phosphate is preferred, meaning that a more than sufficient amount of amine is added to neutralize an acid phosphate, and this neutralization can be done with one or more amines.

The phosphorus compounds disclosed herein can be prepared by well-known reactions. For example, they can be prepared by the reaction of an alcohol or a phenol with phosphorus trichloride or by a transesterification reaction. C6 to C12 alcohols and alkyl phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. In any case, the reaction can be conducted with moderate heating. Moreover, various phosphorus esters can be prepared by reaction using other phosphorus esters as starting materials. Thus, medium chain (C6 to C22) phosphorus esters can be prepared by reaction of dimethylphosphite with a mixture of medium-chain alcohols by means of a thermal transesterification or an acid- or base-catalyzed transesterification; see for example U.S. Pat. No. 4,652,416. Such materials are also commercially available: for instance, triphenyl phosphite is available from Albright and Wilson as Duraphos TPP™; di-n-butyl hydrogen phosphite is available from Albright and Wilson as Duraphos DBHP™; and triphenylthiophosphate is available from BASF as Irgalube TPPT™.

An alkyl or aryl phosphoric acid and a dialkyl or diaryl phosphoric acid, or their mixtures, can be neutralized by one or more amines. Amines that can form amine salts with such phosphoric acids include, for example, mono-substituted amines, di-substituted amines and tri-substituted amines. Examples of mono-substituted amines include butylamine, pentylamine, hexylamine, cyclohexylamine, octylamine, laurylamine, stearylamine, oleylamine and benzylamine. Examples of di-substituted amines include dibutylamine, dipentylamine, dihexylamine, dicyclohexylamine, dioctylamine, dilaurylamine, ditridecylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine.

Polyamines that can form salts with the phosphoric acids provided herein include, for example, alkoxylated diamines, fatty polyamine diamines, alkylenepolyamines, hydroxy containing polyamines, condensed polyamines, arylpolyamines, and heterocyclic polyamines. Examples of fatty diamines include mono- or dialkyl, symmetrical or asymmetrical ethylene diamines, propane diamines (1,2, or 1,3), and polyamine analogs of the above. Suitable commercial fatty polyamines are DUOMEEN® C. (N-coco-1,3-diaminopropane), DUOMEEN® S (N-soya-1,3-diaminopropane), DUOMEEN® T (N-tallow-1,3-diaminopropane), and DUOMEEN® O (N-oleyl-1,3-diaminopropane). "Duomcens" are commercially available from Armak Chemical Co. of Chicago, Ill.

Examples of alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines. Ethylenepolyamines are often a complex mixture of polyalkylenepolyamines, including cyclic condensation products.

Other useful types of polyamine mixtures are those resulting from stripping of mixtures of the above-described polyamines to leave, as residue, what is often termed "polyamine bottoms". In general, alkylenepolyamine bottoms can be characterized as having less than 2 mass %, usually less than 1 mass %, of material boiling below about 200° C. A typical sample of such ethylene polyamine bottoms obtained from the Dow Chemical Company of Freeport, Tex. is designated "E-100". These alkylenepolyamine bottoms include cyclic condensation products such as piperazine and higher analogs of diethylenetriamine, triethylenetetramine, and the like. The alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric amines. Polyhydric amines can include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl) amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris(hydroxymethyl)aminomethane (THAM). Other heterocyclic amines can also include aromatic polycyclic amines. Examples of aromatic polycyclic amines include tolytriazole and benzotriazole.

The amines mentioned above can be used as a neutralization agent for the alkyl or aryl phosphoric acid, dialkyl or diaryl phosphoric acid, or their mixtures as well as an over-neutralization agent to obtain an overbased alkyl or aryl phosphate, or a dialkyl or diaryl phosphate, or their mixtures. The preferred amine phosphate is a dialkylphosphoric acid, first neutralized with a dialkyl amine, and then over-neutralized with a tolytriazole. More preferably, the dialkylphosphoric acid is a dihexylphosporic acid.

The other phosphates that could be used as ashless antiwear include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl)phosphate, tridecyl phosphate, trilauryl phosphate, trimyristyl phosphate, tripalmitoyl phosphate, tristearyl phosphate, and trioleyl phosphate.

Detergent

Illustrative detergents useful in this disclosure include, for example, alkaline earth metal detergents, or mixtures of alkaline earth metal detergents. A typical alkaline earth metal detergent is an anionic material that contains a long chain hydrophobic portion of the molecule and a smaller anionic or oleophobic hydrophilic portion of the molecule. The anionic portion of the detergent is derived from an organic acid such as a sulfur acid, carboxylic acid, phosphorous acid, phenol, or mixtures thereof. The counterion is an alkaline earth metal. Preferably, the detergent comprises at least one alkaline earth metal salt of an organic acid, and the at least one alkaline earth metal salt of an organic acid comprises at least one magnesium salt of an organic acid.

Preferred detergents useful in the lubricating oils of this disclosure are selected from the group consisting of an alkaline earth metal sulfonate, an alkaline earth metal carboxylate (e.g., salicylate), an alkaline earth metal phenate, an alkaline earth metal phosphate, and mixtures thereof. The alkaline earth metal sulfonate, alkaline earth metal carboxylate, alkaline earth metal phenate, alkaline earth metal phosphate, and mixtures thereof, and the amount of the alkaline earth metal sulfonate, alkaline earth metal carboxylate, alkaline earth metal phenate, alkaline earth metal phosphate, and mixtures thereof in the lubricating oil, are sufficient for the engine to exhibit reduced low speed pre-ignition, as compared to low speed pre-ignition performance achieved in an engine using a lubricating oil containing a detergent other than the alkaline earth metal sulfonate, alkaline earth metal carboxylate, alkaline earth metal phenate, alkaline earth metal phosphate, and mixtures thereof, and in an amount other than the amount of the alkaline earth metal sulfonate, alkaline earth metal carboxylate, alkaline earth metal phenate, alkaline earth metal phosphate, and mixtures thereof, in the lubricating oil.

The alkaline earth metal detergents useful in this disclosure can be prepared by convention methods known in the art.

Alkaline earth metal sulfonates are a preferred class of detergents. Sulfur acids useful in preparing the alkaline earth metal sulfonates include sulfonic acids, thiosulfonic, sulfinic, sulfonic, partial ester sulfuric, sulfurous and thiosulfuric acids. Sulfonic acids are preferred.

The sulfonic acids are generally petroleum sulfonic acids or synthetically prepared alkaryl sulfonic acids. Among the petroleum sulfonic acids, the most useful products are those prepared by the sulfonation of suitable petroleum fractions with a subsequent removal of acid sludge, and purification. Synthetic alkaryl sulfonic acids are prepared usually from alkylated benzenes such as the Friedel-Crafts reaction products of benzene and polymers such as tetrapropylene. The following are specific examples of sulfonic acids useful in preparing the alkaline earth metal sulfonate detergents useful in this disclosure. It is to be understood that such examples serve also to illustrate the alkaline earth metal salts of such sulfonic acids. In other words, for every sulfonic acid enumerated, it is intended that the corresponding basic alkaline earth metal salts thereof are also understood to be illustrated.

Such sulfonic acids include mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetra-isobutylene sulfonic acids, tetra-amylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are useful in this disclosure. The latter are acids derived from benzene which has been alkylated with propylene tetramers or isobutene trimers to introduce 1, 2, 3, or more branched-chain C12 substituents on the benzene ring. Dodecyl benzene bottoms, principally mixtures of mono- and di-dodecyl benzenes, are available as by-products from the manufacture of household detergents.

Preferred alkaline earth metal sulfonates include magnesium sulfonate, calcium sulfonate, and mixtures thereof.

Alkaline earth phenates are a useful class of detergents. These detergents can be made by reacting alkaline earth metal hydroxide or oxide ($CaO$, $Ca(OH)_2$, $BaO$, $Ba(OH)_2$, $MgO$, $Mg(OH)_2$, for example) with an alkyl phenol or sulfurized alkylphenol. Useful alkyl groups include straight chain or branched C1-C30 alkyl groups, preferably, C4-C20 or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 weight percent to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Preferred phenate compounds include, for example, magnesium phenate, calcium phenate, an overbased phenate compound, a sulfurized/carbonated calcium phenate compound, and mixtures thereof.

Alkaline earth metal salts of carboxylic acids are also useful as detergents. These carboxylic acid detergents may be prepared by reacting a basic alkaline earth metal compound with at least one carboxylic acid and removing free water from the reaction product. These compounds may be overbased to produce the desired TBN level.

Detergents made from salicylic acid are one preferred class of detergents derived from carboxylic acids. Useful salicylates include long chain alkyl salicylates. One useful family of compositions is of the formula

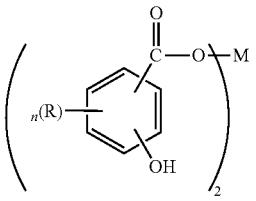

where R is an alkyl group having 1 to about 30 carbon atoms, n is an integer from 1 to 4, and M is an alkaline earth metal. Preferred R groups are alkyl chains of at least C11, preferably C13 or greater. R may be optionally substituted with substituents that do not interfere with the detergent's function. M is preferably calcium, magnesium, or barium. More preferably, M is calcium or magnesium.

Hydrocarbyl-substituted salicylic acids may be prepared from phenols by the Kolbe reaction (described in U.S. Pat. No. 3,595,791). The alkaline earth metal salts of the hydrocarbyl-substituted salicylic acids may be prepared by double decomposition of an alkaline earth metal salt in a polar solvent such as water or alcohol.

Preferred carboxylate compounds comprise a noncarbonated magnesium salicylate (carboxylate); a carbonated magnesium salicylate (carboxylate); a noncarbonated calcium salicylate (carboxylate); a carbonated calcium salicylate (carboxylate); and mixtures thereof.

Salts that contain a substantially stoichiometric amount of the alkaline earth metal are described as neutral salts and have a total base number (TBN, as measured by ASTM D2896) of from 0 to 100. Many compositions are overbased, containing large amounts of a metal base that is achieved by reacting an excess of an alkaline earth metal compound with an acidic gas (such as carbon dioxide). Useful detergents can be neutral, mildly overbased, or highly overbased. These detergents can be used in mixtures of neutral, overbased, highly overbased magnesium salicylate, sulfonates, phenates and/or calcium salicylate, sulfonates, and phenates. The TBN ranges can vary from low TBN of about 0 to 100, medium TBN of about 100 to 200, and high TBN of about 200 to as high as 600. Mixtures of low, medium, and high TBN can be used, along with mixtures of calcium and magnesium metal based detergents, and including sulfonates, phenates, salicylates, and carboxylates. Further examples of mixed TBN detergents can be found as described in U.S. Pat. No. 7,704,930, which is incorporated herein by reference. A detergent mixture with a metal ratio of 1, in conjunction with a detergent with a metal ratio of 2, and as high as a detergent with a metal ratio of 5 or 10 or 15, can be used. Borated detergents can also be used.

Alkaline earth metal phosphates may also be used as detergents and are known in the art.

Detergents may be simple detergents or what is known as hybrid or complex detergents. The latter detergents can provide the properties of two detergents without the need to blend separate materials. Examples may be found in U.S. Pat. No. 6,034,039.

Suitable detergents include magnesium sulfonates, calcium sulfonates, calcium phenates, magnesium phenates, calcium salicylates, magnesium salicylates, and other related components (including borated detergents), and mixtures thereof. Preferred detergents include magnesium sulfonate, calcium sulfonate, magnesium phenate, calcium phenate, magnesium salicylate, calcium salicylate, and mixtures thereof.

Other illustrative detergents that may be used in combination with the alkaline earth metal detergents include, for example, alkali metal detergents, or mixtures of alkali metal detergents.

In a detergent comprising a mixture of a magnesium salt of an organic acid and a calcium salt of an organic acid, the detergent ratio of magnesium metal to calcium metal ranges from about 1:0 to about 1:10, preferably from about 1:0 to about 1:4.

The magnesium and alkaline earth metal contributed by the detergent is present in the lubricating oil in an amount from about 500 ppm to about 5000 ppm, preferably from about 1000 ppm to about 2500 ppm. The magnesium contributed by the detergent is present in the lubricating oil in an amount from about 100 ppm to about 3000 ppm, preferably from about 300 ppm to about 2500 ppm, more preferably from about 750 ppm to about 2000 ppm.

The total base number (TBN), as measured by ASTM D2896, contributed by the detergent ranges from about 2 mg KOH/g to about 17 mg KOH/g, preferably from about 4 mg KOH/g to about 14 mg KOH/g. The TBN contributed by the magnesium detergent ranges from about 2 mg KOH/g to about 17 mg KOH/g, preferably from about 3 mg KOH/g to about 14 mg KOH/g, more preferably from about 5 mg KOH/g to about 10 mg KOH/g.

The detergent may preferably comprise a nonionic detergent. Suitable nonionic detergents include, but are not limited to, polyoxyethylene, polyoxypropylene, polyoxybutylene, alkyl ethers, the like, or any combination thereof. These nonionic detergents may offer increased solubility in base oils including, but not limited to, ester base oils, alkylated naphthalene, squalene, the like, or any combination thereof.

The most preferred nonionic detergents may be ashless nonionic detergents with a Hydrophilic-Lipophilic Balance (HLB) value of 10 or below. Examples of commercially available nonionic detergents include, but are not limited to, ALARMOL™ PS11E and ALARMOL™ PS15E (available from Croda), as well as ECOSURF™ EH-3, TERGITOL™ 15-S-3, TERGITOL™ L-61, TERGITOL™ L-62, TERGITOL™ NP-4, TERGITOL™ NP-6, TERGITOL™ NP-7, TERGITOL™ NP-8, TERGITOL™ NP-9, TRITON™ X-15, and TRITON™ X-35 (all available from Dow Chemical).

The detergent may be included in the lubricant compositions at a concentration from about 0.1 mass % to about 5.0 mass % (or about 0.1 mass % to about 2.0 mass %, or about 0.1 mass % to about 1.0 mass %, or about 0.0 mass % to about 0.8 mass %, or about 0.0 mass % to about 0.6 mass 9%, or about 0.0 mass % to about 0.4 mass %, or about 0.0 mass % to about 0.2 mass %, or about 0.001 mass % to about 1.0 mass %, or about 0.001 mass % to about 0.8 mass %, or about 0.001 mass % to about 0.6 mass %, or about 0.001 mass % to about 0.4 mass %, or about 0.001 mass % to about 0.2 mass %, or about 0.1 mass % to about 0.8 mass %, or about 0.1 mass % to about 0.4 mass %, or about 0.1 mass % to about 0.2 mass %), based on the total mass of the lubricant composition.

Antioxidant

An antioxidant can serve to retard the oxidative degradation of the oil base stock. Such degradation could result in deposits on metal surfaces, the presence of sludge, or a viscosity increase in the lubricant composition. The antioxidant can be or can include, but is not limited to, a phenolic antioxidant, an aminic antioxidant, a polyamine antioxidant, the like, or combinations thereof. The antioxidant may be present in the lubricant compositions at a concentration from about 0.1 mass % to about 10.0 mass % (or about 0.1 mass % to about 8 mass %, or about 0.1 mass % to about 5 mass %, or about 1 mass % to about 5 mass %), by total mass of the lubricant composition.

The phenolic antioxidant is typically a hindered phenolic which contains a sterically hindered hydroxyl group, including, but not limited to, those derivatives of dihydroxy aryl compounds in which the hydroxyl groups are in the o- or p-position to each other. Suitable hindered phenols can include, but are not limited to, hindered phenols substituted with $C_{6+}$ alkyl groups and the alkylene coupled derivatives of those hindered phenols such as 2-t-butyl-4-heptyl phenol, 2-t-butyl-4-octyl phenol, 2-t-butyl-4-dodecyl phenol, 2,6-di-t-butyl-4-heptyl phenol, 2,6-di-t-butyl-4-dodecyl phenol, 2-methyl-6-t-butyl-4-heptyl phenol, and 2-methyl-6-t-butyl-4-dodecyl phenol. Other useful hindered mono-phenolic antioxidants can include, but are not limited to, hindered 2,6-di-alkyl-phenolic proprionic ester derivatives. Bis-phenolic antioxidants can also be advantageously used in combination with the hindered phenolic antioxidants. Suitable ortho-coupled phenols can include, but are not limited to: 2,2'-bis(4-heptyl-6-t-butyl-phenol); 2,2'-bis(4-octyl-6-t-butyl-phenol); and 2,2'-bis(4-dodecyl-6-t-butyl-phenol). Suitable para-coupled bisphenols can include: 4,4'-bis(2,6-di-t-butyl phenol); and 4,4'-methylene-bis(2,6-di-t-butyl phenol).

The aminic antioxidant is typically an aromatic amine antioxidant. Suitable amine antioxidants can include alkylated and non-alkylated aromatic amines such as aromatic monoamines of the formula $R^8R^9R^{10}N$, where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$, where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ can include from 1 to 20 carbon atoms and preferably include from 6 to 12 carbon atoms. Preferably, both $R^8$ and $R^9$ are aromatic or substituted aromatic groups, where the aromatic group can be a fused ring aromatic group such as naphthyl.

Suitable aromatic amine antioxidants can have alkyl substituent groups of at least 6 carbon atoms. Examples of aliphatic groups can include hexyl, heptyl, octyl, nonyl, and decyl. Typically, the aliphatic groups do not contain more than 14 carbon atoms. The general types of amine antioxidants useful in the lubricant composition disclosed herein include diphenylamines, phenyl naphthylamines, phenothiazines, imidodibenzyls and diphenyl phenylene diamines. Mixtures of two or more aromatic amines can be used. Particular examples of suitable aromatic amine antioxidants include: p,p'-dioctyldiphenylamine; t-octylphenyl-alpha-naphthylamine; phenyl-alpha-naphthylamine; and p-octylphenyl-alpha-naphthylamine. Polymeric aminic antioxidants derived from these diphenylamines, phenyl naphthylamines, and their mixtures can also be used. The polymeric aminic antioxidants may be available in a concentrate form with active polymeric amines in the 10 mass % to 40 mass % range. Such polymeric aminic antioxidant concentrates may include, but are not limited to, Nycoperf AO 337 (available from Nyco S.A.).

Other suitable aminic antioxidants include, but are not limited to, polymeric or oligomeric amines which are the polymerization reaction products of one or more substituted or hydrocarbyl-substituted diphenyl amines, one or more unsubstituted or hydrocarbyl-substituted phenyl naphthyl amines, or both one or more of unsubstituted or hydrocarbyl-substituted diphenylamine with one or more unsubstituted or hydrocarbyl-substituted phenyl naphthylamine. A representative schematic is presented below:

(a)

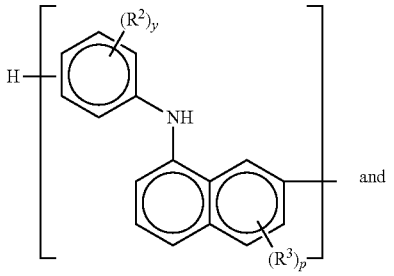

(b)

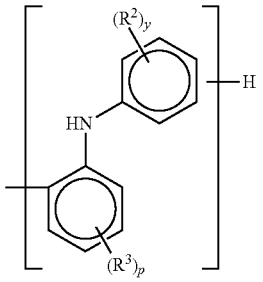

wherein (a) and (b) each range from zero to 10, preferably zero to 5, more preferably zero to 3, most preferably 1 to 3, provided (a)+ (b) is at least 2, for example:

(A)

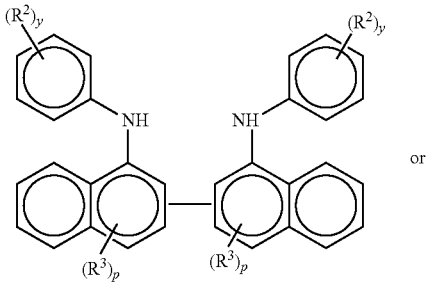

(B)

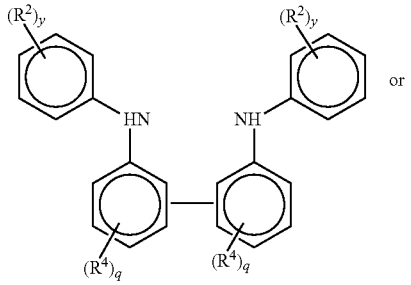

(C)

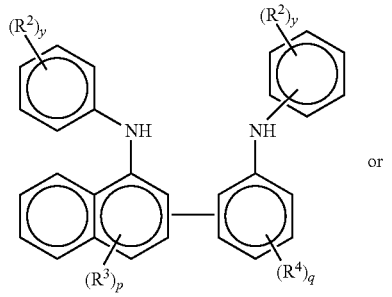

(D)

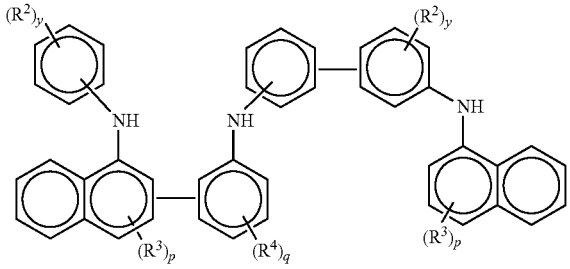

where $R^2$ is a styrene or $C_1$ to $C_{30}$ alkyl, $R^3$ is a styrene or $C_1$ to $C_{30}$ alkyl, $R^4$ is a styrene or $C_1$ to $C_{30}$ alkyl, preferably $R_2$ is a $C_1$ to $C_{30}$ alkyl, $R_3$ is a $C_1$ to $C_{30}$ alkyl, $R_4$ is a $C_1$ to $C_{30}$ alkyl, more preferably $R_2$ is a $C_4$ to $C_{10}$ alkyl, $R_3$ is a $C_4$ to $C_{10}$ alkyl and $R_4$ is a $C_4$ to $C_{10}$ alkyl, p, q and y individually range from 0 to up to the valence of the aryl group to which the respective R group(s) are attached, preferably at least one of p, q and y range from 1 to up to the valence of the aryl group to which the respective R group(s) are attached, more preferably p, q and y each individually range from at least 1 to up to the valence of the aryl group to which the respective R groups are attached. Other more extensive oligomers are within the scope of this disclosure, but materials of formulae A, B, C and D are preferred. Examples can also be found in U.S. Pat. No. 8,492,321.

Dispersants

The lubricant composition can also include one or more dispersants. During engine operation, oil-insoluble oxidation byproducts can be produced. Dispersants can help keep these byproducts in solution, thus diminishing their deposition on metal surfaces. Dispersants used in the formulation of the lubricating composition can be ashless or ash-forming in nature. Preferably, the dispersant is ashless, meaning that it is an organic material that forms substantially no ash upon combustion. For example, non-metal-containing or borated metal-free dispersants are considered ashless. In contrast, metal-containing detergents discussed above form ash upon combustion.

Such dispersants can be present in the lubricant composition in an amount of about 0.1 mass % to about 20.0 mass %, preferably about 0.5 mass % to about 8.0 mass %, or more preferably about 0.5 mass % to 4.0 mass %, based on a total weight of the lubricant composition. The hydrocarbon numbers of the dispersant atoms can range from C60 to C1000, or from C70 to C300, or from C70 to C200. These dispersants may contain both neutral and basic nitrogen or mixtures of both. The dispersants can be end-capped by borates and/or cyclic carbonates.

Suitable dispersants can contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil is normally a polyisobutylene group. Many examples of this type of dispersant are well known commercially and in the literature. See, for example, U.S. Pat. Nos. 3,172,892; 3,215,707; 3,219,666; 3,316,177; 3,341,542; 3,444,170; 3,454,607; 3,541,012; 3,630,904; 3,632,511; 3,787,374; and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; and 5,705,458. A further description of dispersants can be found, for example, in U.S. Pat. No. 5,366,648.

Hydrocarbyl-substituted succinic acid and hydrocarbyl-substituted succinic anhydride derivatives also can be used as dispersants. In particular, succinimide, succinate esters, or succinate ester amides prepared by the reaction of a hydrocarbon-substituted succinic acid compound, preferably having at least 50 carbon atoms in the hydrocarbon substituent, with at least one equivalent of an alkylene amine, are particularly useful. On occasion, having a hydrocarbon substituent having 20 to 50 carbon atoms can be useful.

Succinimides can be formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; 3,652,616; and 3,948,800; and in Canada Patent No. 1,094,044.

Succinate esters can be formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides can be formed by a condensation reaction between hydrocarbyl substituted succinic anhydrides and alkanol amines. Suitable alkanol amines include ethoxylated polyalkylpolyamines, propoxylated polyalkylpolyamines, and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides typically ranges between 800 and 2,500 or more. The above products can be post-reacted with various reagents such as sulfur, oxygen, formaldehyde, and carboxylic acids such as oleic acid. The above products can also be post-reacted with boron compounds such as boric acid, borate esters, and highly borated dispersants, to form borated dispersants generally having from 0.1 to 5.0 moles of boron per mole of dispersant reaction product.

Mannich based dispersants can also be used and are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols can range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products can be prepared from high molecular weight alkyl-substituted hydroxyaromatics or HNR2 group-containing reactants.

Hydrocarbyl substituted amine ashless dispersant additives are well known to those skilled in the art. See, for example, U.S. Pat. Nos. 3,275,554; 3,438,757; 3,565,804; 3,755,433; 3,822,209; and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5,000, or from 1,000 to 3,000, or from 1,000 to 2,000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid ester containing 5 to 25 carbon atoms in the ester group. Representative examples are shown in U.S. Pat. Nos. 2,100,993 and 6,323,164. Polymethacrylate and polyacrylate dispersants are normally used as multifunctional viscosity index improvers. The lower molecular weight versions can be used as lubricant dispersants or fuel detergents.

The use of polymethacrylate or polyacrylate dispersants are preferred in polar esters of a non-aromatic dicarboxylic acid, preferably adipate esters, since many other conventional dispersants are less soluble. The preferred dispersants for polyol esters include polymethacrylate and polyacrylate dispersants.

Other Additives

The lubricant compositions may additionally include other lubricant performance additives known in the art such as corrosion inhibitors, rust inhibitors, metal deactivators, extreme pressure additives, anti-seizure agents, wax modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. Examples may be found in U.S. Pat. No. 7,704,930, which is incorporated by reference herein in its entirety. These additives are commonly delivered with varying amounts of diluent oil that may, for example, range from 5 mass % to 50 mass %. When lubricant compositions include one or more of the foregoing additives, the additive(s) may be blended into the compositions in an amount sufficient for it to perform its intended function.

Method of Operation

The present disclosure may include a method of operation of an internal combustion engine using a lubricant composition as described herein. Such a method may include wherein the engine has a pre-ignition frequency of 2.0% or less at an IMEP (1200 rpm) of from 15 bar to 18 bar (or 15 bar to 17 bar, or 15 bar to 16 bar, or 18 bar or less, or 17 bar or less, or 16 bar or less. Additionally, such a method may include wherein the engine has a pre-ignition frequency of 7.0% or less at an IMEP (1600 rpm) of from 15 bar to 17 bar (or 15 bar to 16 bar, or 17 bar or less, or 16 bar or less).

The fuel combusted in the internal combustion engine of the method described above may comprise any suitable fuel including, but not limited to, hydrogen, a hydrocarbon (e.g., natural gas, gasoline, propane, the like, or any combination thereof), the like, or a combination thereof (e.g., a hydrogen-natural gas blend). The fuel may have a hydrogen concentration of 1 mol % or greater (or 5 mol % or greater, 10 mol % or greater, or 25 mol % or greater, or 50 mol % or greater, or 60 mol % or greater, or 70 mol % or greater, or 80 mol % or greater, or 90 mol % or greater, or 99.9 mol % or greater, or 100 mol % or greater, or 1 mol % to 100 mol %, or 10 mol % to 100 mol %, or 50 mol % to 100 mol %, or 70 mol % to 100 mol %, or 90 mol % to 100 mol %.

EXAMPLES

To facilitate a better understanding of the embodiments of the present invention, the following examples of preferred or representative embodiments are given. In no way should the following examples be read to limit, or to define, the scope of the invention.

Example lubricant compositions IE1-IE3 were formed comprising polyisobutylene, with a kinematic viscosity (ASTM D445, 100° C.) of 5000 cSt as a viscosity modifier. IE1-IE3 comprised basestocks comprising various esters. Additional additives in IE1-IE3 were as specified in Table 1 below. It should be noted that the pentaerythritol ester of branched acids used in IE1 had about 2 mol % primary carbon, about 35 mol % secondary carbon, about 42 mol % tertiary carbon, and about 21 mol % quaternary carbon (as determined by carbon-13 NMR). Additionally a comparative example CE1 was obtained; CE1 comprised a conventional synthetic engine oil that meets standards for SAE 5W-30 and ACEA E6/E7.

TABLE 1

Compositions for IE1-IE3.

| | IE1 | IE2 | IE3 |
|---|---|---|---|
| Polyisobutylene, mass % | 10.00 | 5.00 | 5.00 |
| Neopentylglycol di(3,5,5-trimethylhexanoate), mass % | 71.03 | | |
| Trimethylolpropane tri(3,5,5-trimethylhexanoate), mass % | | 83.03 | |
| Trimethylolpropane ester of C8-C10 acids, mass % | | | 83.03 |
| Pentaerythritol esters of branched acids, mass % | 7.00 | | |
| Phenolic antioxidants, mass % | 1.00 | 1.00 | 1.00 |
| p,p'-dioctyldiphenylamine, mass % | 3.00 | 3.00 | 3.00 |
| Nonionic detergent, mass % | 1.50 | 1.50 | 1.50 |
| Amine Phosphate, mass % | 0.25 | 0.25 | 0.25 |
| Organic friction modifier, mass % | 0.50 | 0.50 | 0.50 |
| Corrosion inhibitor, mass % | 0.02 | 0.02 | 0.02 |
| Dispersants, mass % | 5.50 | 5.50 | 5.50 |
| Pour Point Depressant, mass % | 0.20 | 0.20 | 0.20 |

Samples were tested according to corresponding ASTM procedures (listed below) for properties including kinematic viscosity, viscosity index, high temperature high shear viscosity, as well as mass compositions of trace elements. Results of analysis testing (including ASTM procedures used for each test) are displayed in Table 2 below.

TABLE 2

Analysis testing of IE1-IE3.

| | IE1 | IE2 | IE3 |
|---|---|---|---|
| Kinematic viscosity (cSt) [ASTM D445, 100° C.] | 9.29 | 12.61 | 8.01 |
| Kinematic viscosity (cSt) [ASTM D445, 40° C.] | 55.55 | 107.00 | 41.78 |
| Viscosity Index [ASTM D2270-10R16] | 149 | 111 | 168 |
| High Temp. High Shear Viscosity (cP) [ASTM D4683-20] | 3.26 | 3.95 | 3.09 |
| Boron mass % (ASTM D4591) | 0.0146 | 0.0149 | 0.0146 |
| Calcium mass % (ASTM D4591) | <0.001 | <0.001 | <0.001 |
| Magnesium mass % (ASTM D4591) | <0.001 | <0.001 | <0.001 |
| Molybdenum mass % (ASTM D4591) | <0.001 | <0.001 | <0.001 |
| Sulfur mass % (ASTM D6443-14R19E01) | <0.0005 | <0.0005 | 0.002 |
| Phosphorus mass % (ASTM D4591) | 0.009 | 0.009 | 0.009 |
| Zinc mass % (ASTM D4591) | <0.001 | <0.001 | <0.001 |

Samples (including the comparative example) were tested in a Daimler OM471 base engine, with a single cylinder having direct injection, spark ignition, and a compression ratio (CR) of 10.6. A fuel comprising pure hydrogen (about 100 mol %) was used. The cylinder had a bore length of 132 mm, a stroke length of 156 mm, and a swept volume of 2.13 liters. The cylinder had a boost pressure of 8 bar or less at full load as well as a peak firing pressure of 300 bar or less. Additionally, the piston had a bowl layout optimized for hydrogen combustion. The test engine had a dual overhead cam (DOHC) intake and exhaust camshaft. Engine coolant and oil temperatures were set to 90° C. and intake pressure was set to equal exhaust pressure. $\lambda$=2.4, $Xb_{50}$=8° C. ADaTDC if not specified otherwise. Engine tests were conducted at 1200 revolutions per minute (rpm) as well as at 1600 rpm, for varying indicated mean effective pressures (IMEP).

Pre-ignition (PI) frequency was measured over the course of 1000 cycles at each test condition (e.g., for each revolution speed and IMEP). The PI frequency was determined by pressure curve analysis: a pre-ignition event was recorded when heat release from ignition to minimum burn delay exceeded 2% of total heat release. Results of engine testing for varying IMEP are shown in Table 3 and 4 below, for 1200 rpm and 1600 rpm, respectively, as well as in the FIGURE. The results clearly show that even at high IMEP, IE1-IE3 generally maintained lower PI frequency

TABLE 3

Engine testing pre-ignition frequency results at 1200 rpm.

| IMEP | Pre Ignition Frequency (%) | | | |
|---|---|---|---|---|
| (bar) | CE1 | IE1 | IE2 | IE3 |
| 17 | 2.0 | 1.0 | 1.2 | 1.2 |
| 18 | 3.0 | 1.4 | 2.2 | 4.4 |
| 19 | Too high to measure | 2.0 | 9.4 | 10.2 |

TABLE 4

Engine testing pre-ignition frequency results at 1600 rpm.

| IMEP | Pre Ignition Frequency (%) | | | |
|---|---|---|---|---|
| (bar) | CE1 | IE1 | IE2 | IE3 |
| 15 | 8.6 | 2.2 | 0.2 | 2.0 |
| 16 | 10.6 | 5.2 | 3.0 | 5.4 |
| 17 | Too high to measure | 15.4 | 6.2 | 14.2 |
| 18 | Too high to measure | Too high to measure | 10.2 | Too high to measure |

ADDITIONAL EMBODIMENTS

Embodiments disclosed herein include:

Embodiment 1. A method comprising: lubricating an internal combustion engine using a lubricant composition comprising: from about 30.0 mass % to about 99.8 mass % of an oil base stock, based on a total mass of the lubricant composition, the oil base stock comprising at least one polyol ester; and from 1.0 mass % to 30.0 mass % polyisobutylene, based on a total mass of the lubricant composition; and combusting a fuel in the internal combustion engine.

Embodiment 2. The method of Embodiment 1, wherein the fuel combusted in the internal combustion engine comprises hydrogen, a hydrocarbon, or a combination thereof.

Embodiment 3. The method of Embodiment 2, wherein the fuel has a hydrogen concentration of 50 mol % or greater.

Embodiment 4. The method of any one of Embodiments 1-3, wherein the oil base stock has a kinematic viscosity (ASTM D445) of from 1 cSt to 10 cSt at 100° C.

Embodiment 5. The method of any one of Embodiments 1-4, wherein the oil base stock has a kinematic viscosity (ASTM D445) of from 2 cSt to 8 cSt at 100° C.

Embodiment 6. The method of any one of Embodiments 1-5, wherein the lubricant composition has a kinematic viscosity (ASTM D445) of from 8 cSt to 16 cSt at 100° C.

Embodiment 7. The method of any one of Embodiments 1-6, wherein the lubricant composition has a kinematic viscosity (ASTM D445) of from 9 cSt to 12 cSt at 100° C.

Embodiment 8. The method of any one of Embodiments 1-7, wherein the lubricant composition has a viscosity index (ASTM D2270) from 100 to 180.

Embodiment 9. The method of any one of Embodiments 1-8, wherein the at least one polyol ester comprises a neopentylglycol ester of a C8 to C10 acid, a trimethylolpropane ester of a C8 to C10 acid, mixed pentaerythritol esters of branched alkanoic acids, or any combination thereof.

Embodiment 10. The method of Embodiment 9, wherein the C8 to C10 acid comprises 3,5,5-trimethylhexanoic acid.

Embodiment 11. The method of Embodiment 9 or 10, wherein the neopentylglycol ester of a C8 to C10 acid comprises neopentylglycol di(3,5,5-trimethylhexanoate).

Embodiment 12. The method of any one of Embodiments 9-11, wherein the trimethylolpropane ester of a C8 to C10 acid comprises trimethylolpropane tri(3,5,5-trimethylhexanoate).

Embodiment 13. The method of any one of Embodiments 9-12, wherein the mixed pentaerythritol esters of branched alkanoic acids comprise: from 1 mol % to 5 mol % primary carbon, from 30 mol % to 40 mol % secondary carbon, and from 40 mol % to 50 mol % tertiary carbon, and from 15 mol % to 25 mol % quaternary carbon, as determined by carbon-13 NMR.

Embodiment 14. The method of any one of Embodiments 1-13, wherein the polyisobutylene has a kinematic viscosity (ASTM D445) from 1000 cSt to 6000 cSt at 100° C.

Embodiment 15. The method of any one of Embodiments 1-14, wherein the polyisobutylene has a kinematic viscosity (ASTM D445) from 3000 cSt to 6000 cSt at 100° C.

Embodiment 16. The method of any one of Embodiments 1-15, wherein the at least one polyol ester has at least 25% carbon atoms in the form of methyl groups.

Embodiment 17. The method of any one of Embodiments 1-16, wherein the lubricant composition comprises about 0.05 mass % or less of calcium and about 0.05 mass % or less of magnesium.

Embodiment 18. The method of any one of Embodiments 1-17, wherein the lubricant composition comprises about 0.01 mass % or less of calcium and/or about 0.01 mass % or less of magnesium.

Embodiment 19. The method of any one of Embodiments 1-18, wherein the lubricant composition comprises about 0.05 mass % or less phosphorus and about 0.05 mass % or less sulfur.

Embodiment 20. The method of any one of Embodiments 1-19, wherein the lubricant composition comprises about 0.01 mass % or less phosphorus and/or about 0.01 mass % or less sulfur.

Embodiment 21. The method of any one of Embodiments 1-20, further comprising from about 0.1 mass % to about 10.0 mass % of at least one antioxidant, based on the total mass of the lubricant composition.

Embodiment 22. The method of Embodiment 21, wherein the at least one antioxidant comprises a phenolic antioxidant, an aminic antioxidant, a polyamine antioxidant, or combinations thereof.

Embodiment 23. The method of any one of Embodiments 1-22, further comprising from about 0.1 mass % to about 5.0 mass % of at least one nonionic detergent, based on the total mass of the lubricant composition.

Embodiment 24. The method of any one of Embodiments 1-23, wherein the polyisobutylene has a kinematic viscosity (ASTM D445) of from 4000 cSt to 6000 cSt at 100° C.

Embodiment 25. The method of any one of Embodiments 1-24, wherein the internal combustion engine has a pre-ignition frequency of 2.0% or less at 1200 rpm and an indicated mean effective pressure (IMEP) of from 15 bar to 19 bar.

Embodiment 26. The method of any one of Embodiments 1-25, wherein the internal combustion engine has a pre-ignition frequency of 7.0% or less at 1600 rpm and an indicated mean effective pressure (IMEP) of from 15 bar to 18 bar.

Embodiment 27. A lubricant composition for use as an engine oil, comprising: from about 30.0 mass % to about 99.8 mass % of an oil base stock, based on a total mass of the lubricant composition, the oil base stock comprising at least one polyol ester; and from 1.0 mass % to 30.0 mass % polyisobutylene, based on a total mass of the lubricant composition; wherein the lubricant composition comprises about 0.05 mass % or less ash.

Embodiment 28. The lubricant composition of Embodiment 27, wherein the oil base stock has a kinematic viscosity (ASTM D445) of from 1 cSt to 10 cSt at 100° C.

Embodiment 29. The lubricant composition of Embodiment 28, wherein the oil base stock has a kinematic viscosity (ASTM D445) of from 2 cSt to 8 cSt at 100° C.

Embodiment 30. The lubricant composition of any one of Embodiments 27-29, wherein the lubricant composition has a kinematic viscosity (ASTM D445) of from 8 cSt to 16 cSt at 100° C.

Embodiment 31. The lubricant composition of any one of Embodiments 27-30, wherein the lubricant composition has a kinematic viscosity (ASTM D445) of from 9 cSt to 12 cSt at 100° C.

Embodiment 32. The lubricant composition of any one of Embodiments 27-31, wherein the lubricant composition has a viscosity index (ASTM D2270) from 100 to 180.

Embodiment 33. The lubricant composition of any one of Embodiments 27-32, wherein the at least one polyol ester comprises a neopentylglycol ester of a C8 to C10 acid, a trimethylolpropane ester of a C8 to C10 acid, mixed pentaerythritol esters of branched alkanoic acids, or any combination thereof.

Embodiment 34. The lubricant composition of Embodiment 33, wherein the C8 to C10 acid comprises 3,5,5-trimethylhexanoic acid.

Embodiment 35. The lubricant composition of Embodiment 33 or 34, wherein the neopentylglycol ester of a C8 to C10 acid comprises neopentylglycol di(3,5,5-trimethylhexanoate).

Embodiment 36. The lubricant composition of any one of Embodiments 33-35, wherein the trimethylolpropane ester of a C8 to C10 acid comprises trimethylolpropane tri(3,5,5-trimethylhexanoate).

Embodiment 37. The lubricant composition of any one of Embodiments 33-36, wherein the mixed pentaerythritol esters of branched alkanoic acids comprise: from 1 mol % to 5 mol % primary carbon, from 30 mol % to 40 mol % secondary carbon, and from 40 mol % to 50 mol % tertiary carbon, and from 15 mol % to 25 mol % quaternary carbon, as determined by carbon-13 NMR.

Embodiment 38. The lubricant composition of any one of Embodiments 27-37, wherein the polyisobutylene has a kinematic viscosity (ASTM D445) from 1000 cSt to 6000 cSt at 100° C.

Embodiment 39. The lubricant composition of any one of Embodiments 27-38, wherein the polyisobutylene has a kinematic viscosity (ASTM D445) from 3000 cSt to 6000 cSt at 100° C.

Embodiment 40. The lubricant composition of any one of Embodiments 27-39, wherein the at least one polyol ester has at least 25% carbon atoms in the form of methyl groups.

Embodiment 41. The lubricant composition of any one of Embodiments 27-40, wherein the lubricant composition comprises about 0.05 mass % or less of calcium and about 0.05 mass % or less of magnesium.

Embodiment 42. The lubricant composition of any one of Embodiments 27-41, wherein the lubricant composition comprises about 0.01 mass % or less of calcium and/or about 0.01 mass % or less of magnesium.

Embodiment 43. The lubricant composition of any one of Embodiments 27-42, wherein the lubricant composition comprises about 0.05 mass % or less phosphorus and about 0.05 mass % or less sulfur.

Embodiment 44. The lubricant composition of any one of Embodiments 27-43, wherein the lubricant composition comprises about 0.01 mass % or less phosphorus and/or about 0.01 mass % or less sulfur.

Embodiment 45. The lubricant composition of any one of Embodiments 27-44, further comprising from about 0.1 mass % to about 10.0 mass % of at least one antioxidant, based on the total mass of the lubricant composition.

Embodiment 46. The lubricant composition of Embodiment 45, wherein the at least one antioxidant comprises a phenolic antioxidant, an aminic antioxidant, a polyaminic antioxidant, or combinations thereof.

Embodiment 47. The lubricant composition of any one of Embodiments 27-46, further comprising from about 0.1 mass % to about 5.0 mass % of at least one nonionic detergent, based on the total mass of the lubricant composition.

Embodiment 48. The lubricant composition of any one of Embodiments 27-47, wherein the polyisobutylene has a kinematic viscosity (ASTM D445) of from 4000 cSt to 6000 cSt at 100° C.

Embodiment 49. A lubricant composition for use as an engine oil, comprising: from about 30.0 mass % to about 99.8 mass % of an oil base stock, based on a total mass of the lubricant composition, wherein the oil base stock has a kinematic viscosity (ASTM D445) of from 1 cSt to 10 cSt at 100° C.; and from 1.0 mass % to 30.0 mass % polyisobutylene, based on a total mass of the lubricant composition; and wherein the lubricant composition comprises about 0.05 mass % or less ash.

Therefore, the present invention is well adapted to attain the ends and advantages mentioned as well as those that are inherent therein. The particular examples and configurations disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the incarnations of the present inventions. At the very least, and not as an attempt to limit the application of the doctrine of equivalents to the scope of the claim, each numerical parameter should at least be construed in light of the number of reported significant digits and by applying ordinary rounding techniques.

One or more illustrative incarnations incorporating one or more invention elements are presented herein. Not all features of a physical implementation are described or shown in this application for the sake of clarity. It is understood that in the development of a physical embodiment incorporating one or more elements of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

What is claimed is:

1. A method comprising:

lubricating an internal combustion engine using a lubricant composition comprising:

from about 30.0 mass % to about 99.8 mass % of an oil base stock, based on a total mass of the lubricant composition, the oil base stock comprising at least one polyol ester; and from 1.0 mass % to 30.0 mass % polyisobutylene, based on a total mass of the lubricant composition, wherein the polyisobutylene is a viscosity modifier having a molecular weight ranging from about 10,000 Da to about 1,500,000 Da and a kinematic viscosity (ASTM D445) from 1000 cSt to 6000 cSt at 100° C.; and combusting a fuel in the internal combustion engine.

2. The method of claim 1, wherein the fuel combusted in the internal combustion engine comprises hydrogen, a hydrocarbon, or a combination thereof.

3. The method of claim 2, wherein the fuel has a hydrogen concentration of 50 mol % or greater.

4. The method of claim 1, wherein the oil base stock has a kinematic viscosity (ASTM D445) of from:

(a) 1 cSt to 10 cSt at 100° C.;

(b) 2 cSt to 8 cSt at 100° C.;

(c) 8 cSt to 16 cSt at 100° C.; or, (d) 9 cSt to 12 cSt at 100° C.

5. The method of claim 1, wherein the lubricant composition has a viscosity index (ASTM D2270) from 100 to 180.

6. The method of claim 1, wherein the at least one polyol ester comprises a neopentylglycol ester of a C8 to C10 acid, a trimethylolpropane ester of a C8 to C10 acid, mixed pentaerythritol esters of branched alkanoic acids, or any combination thereof.

7. The method of claim 6:

(a) wherein the C8 to C10 acid comprises 3,5,5-trimethylhexanoic acid;

(b) wherein the neopentylglycol ester of a C8 to C10 acid comprises neopentylglycol di(3,5,5-trimethylhexanoate);

(c) wherein the trimethylolpropane ester of a C8 to C10 acid comprises trimethylolpropane tri(3,5,5-trimethylhexanoate);

(d) wherein the mixed pentaerythritol esters of branched alkanoic acids comprise: from 1 mol % to 5 mol % primary carbon, from 30 mol % to 40 mol % secondary carbon, and from 40 mol % to 50 mol % tertiary carbon, and from 15 mol % to 25 mol % quaternary carbon, as determined by carbon-13 NMR;

or a combination of the above.

8. The method of claim 1, wherein the at least one polyol ester has at least 25% carbon atoms in the form of methyl groups.

9. The method of claim 1, wherein the lubricant composition comprises:

(a) about 0.05 mass % or less of calcium and about 0.05 mass % or less of magnesium;

(b) about 0.05 mass % or less phosphorus and about 0.05 mass % or less sulfur;

(c) or both (a) and (b).

10. The method of claim 1, further comprising from about 0.1 mass % to about 10.0 mass % of at least one antioxidant, based on the total mass of the lubricant composition and wherein the at least one antioxidant comprises a phenolic antioxidant, an aminic antioxidant, a polyaminic antioxidant, or combinations thereof.

11. The method of claim 1, wherein the internal combustion engine (a) has a pre-ignition frequency of 2.0% or less at 1200 rpm and an indicated mean effective pressure (IMEP) of from 15 bar to 19 bar or (b) has a pre-ignition frequency of 7.0% or less at 1600 rpm and an indicated mean effective pressure (IMEP) of from 15 bar to 18 bar.

12. The method of claim 1, wherein the lubricant composition further comprises from about 0.1 mass % to about 5.0 mass % of at least one detergent, based on the total mass of the lubricant composition.

13. The method of claim 11, wherein the fuel has a hydrogen concentration of 50 mol % or greater.

14. A lubricant composition for use as an engine oil, comprising:

from about 30.0 mass % to about 99.8 mass % of an oil base stock, based on a total mass of the lubricant composition, the oil base stock comprising at least one polyol ester;

from about 0.1 mass % to about 5.0 mass % of at least one detergent, based on the total mass of the lubricant composition; and from 1.0 mass % to 30.0 mass % polyisobutylene, based on a total mass of the lubricant composition;

wherein the polyisobutylene is a viscosity modifier having a molecular weight ranging from about 10,000 Da to about 1,500,000 Da and a kinematic viscosity (ASTM D445) from 1000 cSt to 6000 cSt at 100° C.; and wherein the lubricant composition comprises about 0.05 mass % or less ash.

15. The lubricant composition of claim 14, wherein the oil base stock has a kinematic viscosity (ASTM D445) of from:

(a) 1 cSt to 10 cSt at 100° C.;

(b) 2 cSt to 8 cSt at 100° C.;

(c) 8 cSt to 16 cSt at 100° C.; or, (d) 9 cSt to 12 cSt at 100° C.

16. The lubricant composition of claim 15, wherein the lubricant composition has a viscosity index (ASTM D2270) from 100 to 180.

17. The lubricant composition of claim 15, wherein the at least one polyol ester comprises a neopentylglycol ester of a C8 to C10 acid, a trimethylolpropane ester of a C8 to C10 acid, mixed pentaerythritol esters of branched alkanoic acids, or any combination thereof.

18. The lubricant composition of claim 17, wherein (a) the C8 to C10 acid comprises 3,5,5-trimethylhexanoic acid;

(b) the neopentylglycol ester of a C8 to C10 acid comprises neopentylglycol di(3,5,5-trimethylhexanoate);

(c) the trimethylolpropane ester of a C8 to C10 acid comprises trimethylolpropane tri(3,5,5-trimethylhexanoate);

(d) the mixed pentaerythritol esters of branched alkanoic acids comprise: from 1 mol % to 5 mol % primary carbon, from 30 mol % to 40 mol % secondary carbon, and from 40 mol % to 50 mol % tertiary carbon, and from 15 mol % to 25 mol % quaternary carbon, as determined by carbon-13 NMR;

or any combination thereof.

19. The lubricant composition of claim 14, wherein the at least one polyol ester has at least 25% carbon atoms in the form of methyl groups.

20. The lubricant composition of claim 14, wherein the lubricant composition comprises (a) about 0.05 mass % or less of calcium and about 0.05 mass % or less of magnesium, (b) about 0.05 mass % or less phosphorus and about 0.05 mass % or less sulfur, or both (a) and (b).

21. The lubricant composition of claim 14, wherein the polyisobutylene has a kinematic viscosity (ASTM D445) of from 4000 cSt to 6000 cSt at 100° C.

22. The lubricant composition of claim 14, wherein the at least one detergent is an ashless nonionic detergent having a Hydrophilic-Lipophilic Balance (HLB) of 10 or below.

23. The lubricant composition of claim 14, wherein the at least one detergent is a detergent that contributes a total base number (TBN) (ASTM D2896) of about 2 mg KOH/g to about 17 mg KOH/g.

24. A lubricant composition for use as an engine oil, comprising:

from about 30.0 mass % to about 99.8 mass % of an oil base stock, based on a total mass of the lubricant composition, wherein the oil base stock has a kinematic viscosity (ASTM D445) of from 1 cSt to 10 cSt at 100° C.;

from about 0.1 mass % to about 5.0 mass % of at least one detergent, based on the total mass of the lubricant composition; and from 1.0 mass % to 30.0 mass % polyisobutylene, based on a total mass of the lubricant composition;

wherein the polyisobutylene is a viscosity modifier having a molecular weight ranging from about 10,000 Da to about 1,500,000 Da and a kinematic viscosity (ASTM D445) from 1000 cSt to 6000 cSt at 100° C.; and wherein the lubricant composition comprises about 0.05 mass % or less ash.

* * * * *